US006648176B1

(12) United States Patent
Donovan

(10) Patent No.: US 6,648,176 B1
(45) Date of Patent: Nov. 18, 2003

(54) SAFETY TOOTHPASTE CONTAINERS

(76) Inventor: James A. Donovan, 8805 Roberts Rd., Odessa, FL (US) 33556

( * ) Notice: Subject to any disclaimer, the term of this patent is extended or adjusted under 35 U.S.C. 154(b) by 0 days.

(21) Appl. No.: 10/075,030

(22) Filed: Feb. 12, 2002

(51) Int. Cl.[7] ..... B65D 35/08; B65D 85/14
(52) U.S. Cl. ..... 222/107; 206/277; 424/49
(58) Field of Search ..... 222/105, 107, 222/108, 109; 206/45.31, 229, 277, 459; 424/49

(56) References Cited

U.S. PATENT DOCUMENTS 4,863,014 A * 9/1989 Summons et al. ..... 206/45.31
6,331,291 B1 * 12/2001 Glace et al. ..... 424/49

* cited by examiner

*Primary Examiner*—Paul J. Hirsch
(74) *Attorney, Agent, or Firm*—John S. Munday

(57) ABSTRACT

A soft, non sharp toothpaste container for use after inspection for tampering and having a clear packet sized to include sufficient toothpaste gel for one brushing. A toothpaste gel is put in the packet, the gel being essentially transparent. The packet is sealed during manufacture to prevent insertion of additional contents without visible violation of the packet. The packet may contain printing that is sufficiently clear to permit visual inspection of the packet prior to use. When the packet is formed as a toothpaste tube having a removable cap, the cap and body of the tube are soft and flexible. Otherwise, the packet includes a score cut to permit opening by tearing on the score cut.

18 Claims, 1 Drawing Sheet

SAFETY TOOTHPASTE CONTAINERS

FIELD OF THE INVENTION

This invention relates to toothpaste in a container. More particularly, the invention relates to a safety toothpaste and container which is optically clear to permit visual inspection and monitoring, particularly in security systems such as jails, prisons and the like.

BACKGROUND OF THE INVENTION

One of the main problems in security systems such as jails, prisons and detention centers is the need to provide hygienic conditions without giving the inmates an opportunity to do violence to others or themselves.

In minimum security facilities, inmates are relatively trustworthy and not prone to violence with one another, but the concern still exists since those in prison often act out with unpredictable behavior. In more strict confinement, extreme caution must be exercised to prevent, as much as possible, those who are incarcerated from being given any object which can be turned into a weapon. Again, while basic hygiene needs to be provided to inmates, at least at their own option, the use of anything in which a weapon may be hidden represents a serious concern for all.

In prior efforts at dental hygiene, concern has been that the tooth brush might be modified to present a dangerous weapon, such as when the handle might be sharpened, such as by grinding the handle on a cement wall or floor. Use of materials which do not have sufficient strength to remain rigid when used to stab another human being, have substantially overcome this problem. However, efforts have been made to hide or conceal a weapon, such as a razor blade, knife or other object, inside the tube of toothpaste. Inspection of toothpaste tubes by guards or safety personnel is difficult and time consuming, and therefore often does not get done in a proper manner. Because of the use of opaque plastics, all commercially available toothpastes are not inspectable.

It would be a great advantage to the correction system if an improved toothpaste tube could be developed that would be easily inspected, and not permit concealing any other material therein, the tube being clearly observable from a safe distance.

It is therefore an object of this invention to provide safety toothpaste and toothpaste tube that is usable by inmates in a prison or other confined facility without giving the user a device that may conceal a dangerous weapon.

Another object is to provide a safety toothpaste tube and paste design that permits easy and accurate inspection by officials of a facility.

Yet another object of the present invention is to provide a safety toothpaste tube of disposable construction and low cost without the use of hard or opaque materials.

Other objects will appear hereinafter.

SUMMARY OF THE INVENTION

It has now been discovered that the above and other objects of the present invention may be accomplished in the following manner. The unique aspect of this invention is the use of a clear material for compact design to construct a safety toothpaste tube or toothpaste dispenser so that any unapproved device would be clearly obvious by inspection at a reasonable distance, such as from outside a prison cell when an inmate is requested to show the device to a guard.

The safety device of this invention includes a clear gel toothpaste and either a tube or a packet for containing the clear gel toothpaste. The tubes or packets are manufactured from a clear, soft but impermeable material such as polypropylene or other such material having sufficient clarity to permit easy observance of the contents of the tube. The openings of the tube and the packet are formed by heat seal, to prevent insertion of a forbidden object therein after manufacture, and to maintain the flexibility and softness necessary to prevent the device from being used as a weapon. Instructions, labels, and required information are printed on the packet in transparent colored film or label that provides the desired writing without obstructing the clarity of the package.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
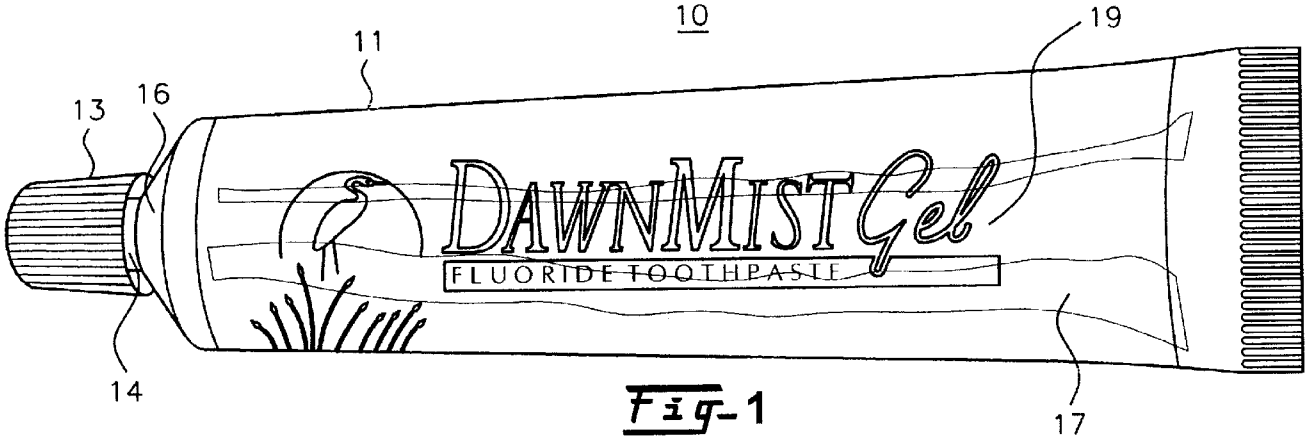
FIG. 1 is a perspective view of one embodiment of the present invention, in the form of a toothpaste tube.
Figure 2:
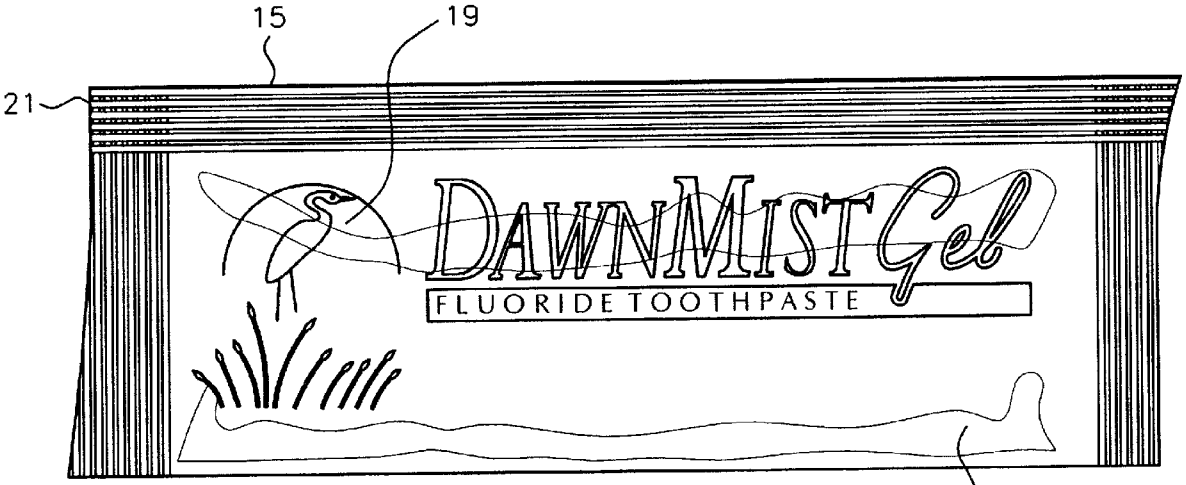
FIG. 2 is a perspective view of one embodiment of the present invention, in the form of a single use toothpaste packet.

As shown in FIG. 1, the device 10 comprises a toothpaste tube 11 with cap 13 and/or a toothpaste packet 15, shown in FIG. 2, into which a toothpaste gel 17 has been placed during manufacture of the safety device. The gel 17 can be any effective formulation for dental hygiene as long as the gel is clear or essentially transparent.

Both FIGS. 1 and 2 illustrate packages or containers that are soft and contain no hard or sharp surfaces or edges. Also illustrated on packages 11 and/or 15 are logos, instructions, lists of ingredients, and the like, generally illustrated by reference numeral 19.

One preferred formulation, for either the tube or the packet, comprises a clear gel having an active ingredient comprising sodium monoflouorophosphate in an amount ranging from less that 0.25% to 1.5%, with about 0.75% being preferred. The balance of the gel includes formulation amounts of sorbitol silica, purified water, cocamidoproply betaine, xantham gum, sodium benzoate, peppermint oil and sodium saccharin in proportions normally used in toothpaste gels. The single most important factor is to be sure the gel is clear or, as noted, essentially transparent in order to accomplish the goals of the invention When the invention is in the packet form, it is filled and sealed at the factory, usually being filled after the logo, instructions, ingredients and other printed material are placed on the flexible, clear plastic. Since it contains a single dosage of toothpaste gel, it is intended to be discarded after use. Packet 15 includes a score cut 21 to permit opening by tearing on said score cut. However, before or after being used, it is sufficiently soft and flexible so that it cannot be used as a weapon.

When the invention is in the toothpaste tube form, the cap and body of the tube are, again, sufficiently soft and flexible so that it is harmless. The opening 14 of the cap which covers end tube 16 of tube 11 is intentionally small giving the user a mild inconvenience in having to squeeze hard to get an adequate amount of toothpaste gel for daily use from tube 11 in order to insure that nothing of substance or size can be inserted into the tube once it has been opened. Since it is sealed at the factory and can be inspected before being given to a user, and since it, too, is intended to be discarded after use, it provides no opportunity for improper use by inmates at security institutions. Again, placement of the logo, instructions, ingredients and other printed material on the tube in a colored transparent film or ink does not impede the ability to inspect the tube.

Clear polypropylene and other transparent plastic materials are well suited for use as the tubes and packages of the present invention.

While particular embodiments of the present invention have been illustrated and described, it is not intended to limit the invention to any specific embodiment. The dimensions and materials given are for the preferred embodiment and are not to be construed as limitations on the scope of this invention. The description of the invention is not intended to limit the invention

What is claimed is:

1. A toothpaste container device for use after inspection for tampering, comprising:

a clear packet sized to include sufficient toothpaste gel for one brushing, said packet being soft and containing no hard or sharp surfaces or edges;

toothpaste gel in said packet in an amount sufficient for one brushing, said gel being essentially transparent, said packet being sealed during manufacture after insertion of said gel to prevent insertion of additional contents without visible violation of said packet; and printing on said packet, said printing being sufficiently clear to permit visual inspection of said packet prior to use.

2. The device of claim 1, where said printing includes at least one printing selected from logos, instructions, and lists of ingredients.

3. The device of claim 1, wherein said gel has an active ingredient comprising sodium monoflouorophosphate in an amount ranging from less that 0.25% to 1.5% by weight.

4. The device of claim 3, where said active ingredient comprises about 0.75% by weight.

5. The device of claim 4, wherein the balance of said gel includes formulation amounts of sorbitol, silica, purified water, cocamidoproply betaine, xantham gum, sodium benzoate, peppermint oil, and sodium saccharin in proportions to form a toothpaste gel.

6. The device of claim 1, wherein said packet is formed as a toothpaste tube having a removable cap, said cap and body of the tube being soft and flexible.

7. The device of claim 6, wherein said cap includes an opening sufficiently small to require the user to squeeze hard to get an adequate amount of toothpaste gel for daily use to insure that nothing of substance or size can be inserted into the tube once it has been opened.

8. The device of claim 1, wherein said packet includes a score cut to permit opening by tearing on said score cut.

9. The device of claim 1, wherein said packet is formed from clear polypropylene.

10. A toothpaste container device for use after inspection for tampering, comprising:

clear packet means for holding sufficient toothpaste gel for one brushing, said packet means being soft and containing no hard or sharp surfaces or edges;

toothpaste gel in said packet means in an amount sufficient for one brushing, said gel being essentially transparent, said packet means being sealed during manufacture after insertion of said gel to prevent insertion of additional contents without visible violation of said packet; and printing on said packet means, said printing being sufficiently clear to permit visual inspection of said packet means prior to use.

11. The device of claim 10, where said printing includes at least one printing selected from logos, instructions, and lists of ingredients.

12. The device of claim 10, wherein said gel has an active ingredient comprising sodium monoflouorophosphate in an amount ranging from less that 0.25% to 1.5% by weight.

13. The device of claim 12, where said active ingredient comprises about 0.75% by weight.

14. The device of claim 13, wherein the balance of said gel includes formulation amounts of sorbitol, silica, purified water, cocamidoproply betaine, xantham gum, sodium benzoate, peppermint oil, and sodium saccharin in proportions to form a toothpaste gel.

15. The device of claim 10, wherein said packet is formed as a toothpaste tube having a removable cap, said cap and body of the tube being soft and flexible.

16. The device of claim 15, wherein said cap includes an opening sufficiently small to require the user to squeeze hard to get an adequate amount of toothpaste gel for daily use to insure that nothing of substance or size can be inserted into the tube once it has been opened.

17. The device of claim 10, wherein said packet includes a score cut to permit opening by tearing on said score cut.

18. The device of claim 10, wherein said packet is formed from clear polypropylene.

* * * * *